US009248940B1

(12) United States Patent
Liao et al.

(10) Patent No.: US 9,248,940 B1
(45) Date of Patent: Feb. 2, 2016

(54) STORAGE CASE

(71) Applicants: Ying-Chieh Liao, Taichung (TW); Yu-Kuo Liao, Taichung (TW)

(72) Inventors: Ying-Chieh Liao, Taichung (TW); Yu-Kuo Liao, Taichung (TW)

( * ) Notice: Subject to any disclaimer, the term of this patent is extended or adjusted under 35 U.S.C. 154(b) by 0 days.

(21) Appl. No.: 14/546,682

(22) Filed: Nov. 18, 2014

(51) Int. Cl.
*B65D 85/28* (2006.01)
*B65D 25/20* (2006.01)

(52) U.S. Cl.
CPC ..... *B65D 25/20* (2013.01)

(58) Field of Classification Search
CPC combination set(s) only.
See application file for complete search history.

(56) References Cited

U.S. PATENT DOCUMENTS 6,415,924 B1 * 7/2002 Lee ..... B25H 3/023 206/373
2002/0185392 A1 * 12/2002 Hummell ..... B65D 21/022 206/307
2005/0247586 A1 * 11/2005 Chen ..... B25H 3/02 206/372
2006/0091036 A1 * 5/2006 Casella ..... A45C 9/00 206/457
2011/0100854 A1 * 5/2011 Chapin ..... B65D 17/165 206/459.5
2011/0303572 A1 * 12/2011 Rajpoot ..... B65D 1/0223 206/459.5
2013/0327784 A1 * 12/2013 Goldschmidt ..... B65D 43/16 220/811
2015/0060316 A1 * 3/2015 Lee ..... B25H 3/02 206/349

FOREIGN PATENT DOCUMENTS

TW M463640 10/2013
TW I422474 1/2014
TW M471966 2/2014

* cited by examiner

*Primary Examiner* — Jacob K Ackun
(74) *Attorney, Agent, or Firm* — Muncy, Geissler, Olds & Lowe, P.C.

(57) ABSTRACT

A storage case is provided, including two shell bodies correspondingly foldably and unfoldably connected to each other. Each shell body includes a main body and a color ring arranged around a circumferential edge at an end of the main body, and a color of the color ring is different from a color of the main body. When the two shell bodies are correspondingly folded, the two color rings are substantially disposed parallel to each other in intervals and located at opposite end edges remote from each other of the two shell bodies. When the two shell bodies are unfolded and located neighboring to and parallel to each other, the two color rings are disposed, substantially, neighboring to each other on the same level.

10 Claims, 5 Drawing Sheets

STORAGE CASE

BACKGROUND OF THE INVENTION

1. Field of the Invention

The present invention relates to a case, and more particularly to a storage case.

2. Description of the Prior Art

It is ordinary to use hand tools in our daily life such as in house or in factory, and the hand tools or other similar tools are widely used in industries. Generally, the hand tools or the similar tools are stored in a storage case to keep a working place clean and in order so that it saves time to pick up a demanding tool to use. So it is really important to have the storage case for storing the hand tools or the similar tools.

A prior art of the storage case is composed of two shell bodies which are correspondingly foldably and unfoldably connected to each other. Each said shell body has a space for receiving the hand tools or the similar tools, or the shell body is internally formed with a plurality of receiving slots which are separated by block plates or overlaid with stepping layers for receiving the hand tools. By using the two shell bodies as described above, the two shell bodies can be unfolded and the hand tools or the similar tools can be stored in the storage case. The prior art is disclosed in TW M471966, TW I422474 and TW M463640.

However, a structure as described above has single color or is unformed with an identifying portion for corresponding to different types of tools. To identify the hand tools stored in the storage case, it is necessary to open the storage case or to paste a label up on the storage case, and it is inconvenient. Furthermore, when the storage cases are unfolded/folded and overlaid on each other, it is hard to identify the hand tools stored in the storage cases because the storage cases have the same structure but have no identifying structures. It is easy to confuse and hard to identify the tools, and it is hard to categorize the tools.

The present invention has arisen to mitigate and/or obviate the afore-described disadvantages.

SUMMARY OF THE INVENTION

The primary object of the present invention is to provide a storage case, for quickly and clearly identify a kind of tool stored in the storage case. It is convenient for categorizing different kinds of tools and helpful to store the tools. It is also convenient to pick up a demanding part from the storage cases which are overlaid on each other.

To achieve the above object, a storage case in accordance with present invention includes two shell bodies correspondingly foldably and unfoldably connected to each other. Each said shell body includes a main body and a color ring arranged around a circumferential edge at an end of the main body. A color of the color ring is different from a color of the main body. Wherein when the two shell bodies are correspondingly folded, the two color rings are disposed substantially parallel to each other in intervals and located at opposite end edges remote from each other of the two shell bodies; when the two shell bodies are unfolded to locate neighboring to each other and parallel arranged side by side, the two color rings are substantially disposed neighboring to each other on a same level.

DETAILED DESCRIPTION OF THE PREFERRED EMBODIMENTS

Figure 1:
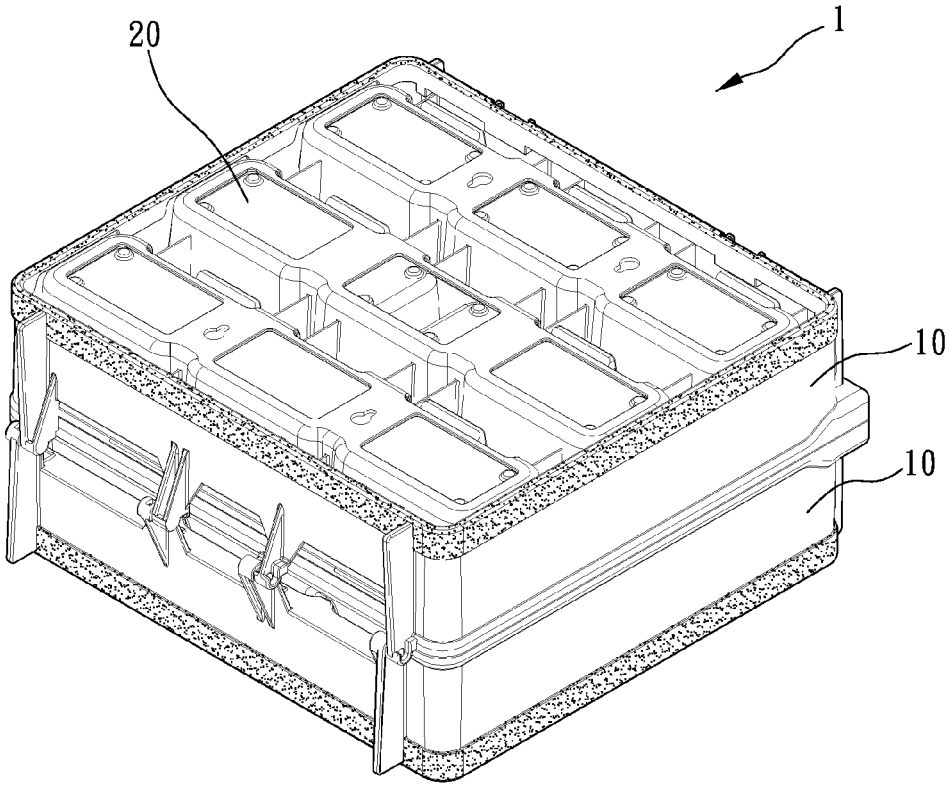
FIG. 1 is a three-dimensional drawing of a preferred embodiment of the present invention.
Figures 2, 2A:
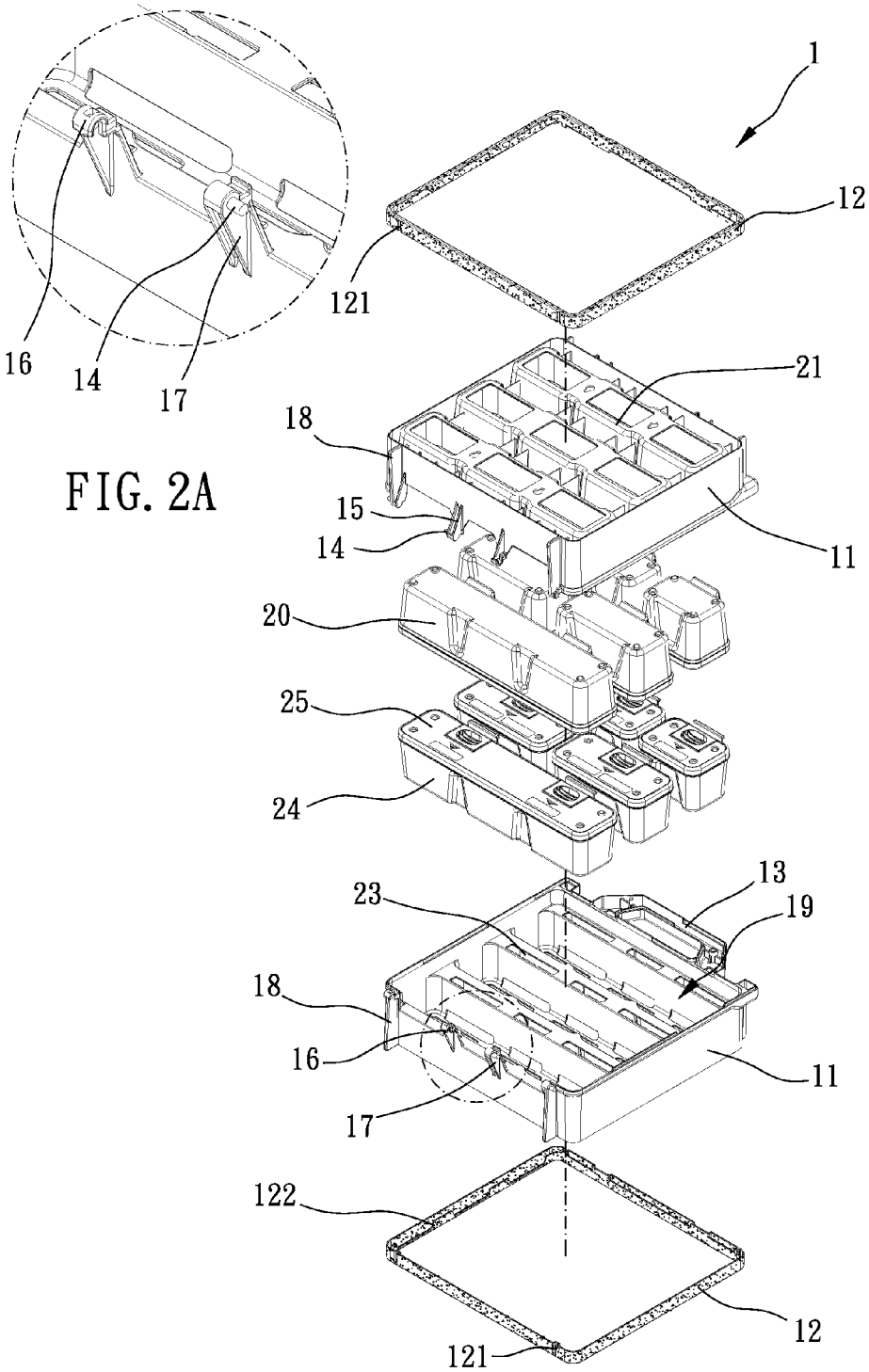
FIG. 2 is a breakdown drawing of the preferred embodiment of the present invention.
FIG. 2A is a partial enlarging drawing of FIG. 2.
Figure 3:
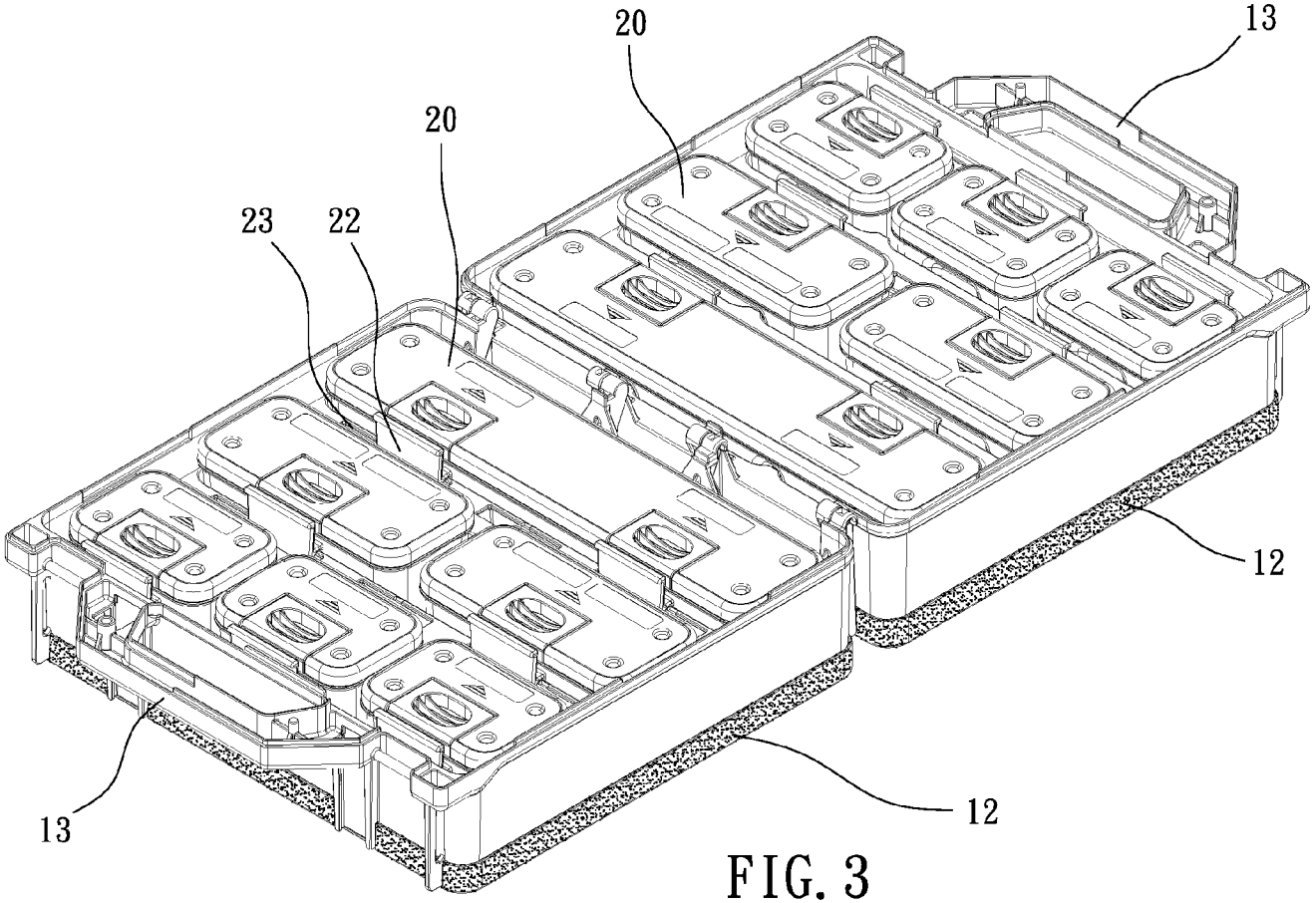
FIG. 3 is a perspective drawing of the preferred embodiment of the present invention unfolded.

The present invention will be clearer from the following description when viewed together with the accompanying drawings, which show, for purpose of illustrations only, the preferred embodiment in accordance with the present invention.

Please refer to FIGS. 1, 2, 2A and 3, a storage case 1 in accordance with a preferred embodiment of the present invention includes two shell bodies 10 correspondingly foldably and unfoldably connected to each other. Each said shell body 10 includes a main body 11 and a color ring 12 arranged around a circumferential edge at an end of the main body 11. A color of the color ring 12 is different from a color of the main body 11. Wherein when the two shell bodies 10 are correspondingly folded, the two color rings 12 are substantially disposed parallel to each other up and down in intervals and located at opposite end edges remote from each other of the two shell bodies 10. When the two shell bodies 10 are unfolded to locate neighboring to each other and parallel arranged side by side, the two color rings 12 are disposed substantially neighboring to each other on a same level.

At least one of the main bodies 11 of the shell bodies 10 is provided with a handle portion 13 for gripping. Specifically, each said main body 11 is formed with one said handle portion 13. When the two shell bodies 10 are correspondingly folded, the two handle portions 13 are formed to be a portable handle.

One of the two main bodies 11 of the two shell bodies 10 is formed with a first pivot portion 14 and a first rib portion 15 which extends from the first pivot portion 14 and is substantially perpendicular to a direction of a pivot axis of the first pivot portion 14, and the other of the two main bodies 11 of the two shell bodies 10 is formed with a second pivot portion 16 and extendingly formed with a second rib portion 17 substantially perpendicular to a direction of a pivot axis of the second pivot portion 16. The two shell bodies 10 are pivoted to each other via the first and second pivot portions 14, 16 and correspondingly foldably and unfoldably connected to each other. Furthermore, at least one of the two main bodies 11 of the two shell bodies 10 is protrudingly formed with at least one spacer 18. After the two shell bodies 10 are unfolded, the spacer 18 abuts against between two opposite sides of the two shell bodies 10 and keeps the two shell bodies 10 to locate neighboring to and parallel to each other. Specifically, one of the two shell bodies 10 is formed with two said first rib portions 15 and the other one is formed with two said second rib portions 17. The two shell bodies 10 are respectively protrudingly formed with a plurality of said spacers 18. Each said spacer 18 is substantially a wedge-shaped rib plate transverse to the color ring 12, and the wedge-shaped rib plate expands towards the color ring 12. The first and second rib portions 15, 17 can increase structural strength of the first and second pivot portions 14, 16. The spacers 18 can locate relative positions of the two shell bodies 10 after the two shell bodies 10 are unfolded and prevent the two shell bodies 10 from excessively pivoting to damage the first and second pivot portions 14, 16.

Preferably, each said color ring 12 is formed with at least one engaging slot 121 on an outer circumferential surface and formed with a block slot 122 (or one circumferential slot, or a plurality of block slots disposed in intervals) on a side towards the circumferential edge of the main body 11. Each said block slot 122 and one of the circumferential edges of one said main body 11 are engaged with each other, and each said engaging slot 121 and an end of one said spacer 18 are engaged with each other. Practically, each said color ring 12 is formed with a plurality of said engaging slots 121 to steadily engage to the spacers 18. It is noted that each said color ring 12 can be designed to detachably connect to one of the circumferential edges of one said main body 11. The color ring 12 and the main body 11 can be formed integrally.

In the present embodiment, an interior of each said main body 11 defines at least one receiving space 19. At least one part receiving box 20 is detachably engagingly disposed and positioned in the receiving space 19. Specifically, the interior of the main body 11 includes a plurality of engaging ribs 21. At least two said engaging ribs 21 define one said receiving space 19. At least one engaging hook 22 of each said part receiving box 20 engages with the engaging rib 21 and is positioned in one said receiving space 19. Preferably, each said engaging rib 21 includes at least one (or a plurality of) engaging slot 23, and the engaging slot 23 is for the engaging hook 22 to insert therein and engage therewith. Each said part receiving box 20 includes a box body 24 and a cover plate 25. The box body 24 is detachably engaged with the shell body and positioned in the receiving space 19. The cover plate 25 is liftably covered on a side of the box body 24. In practical use, different kinds of parts are conveniently separated and stored in each said part receiving box 20. When the storage case 1 or single said shell body 10 is carried and moved, the parts are received in the part receiving box 20 and unfallen out from the part receiving box 20.

Figure 4:
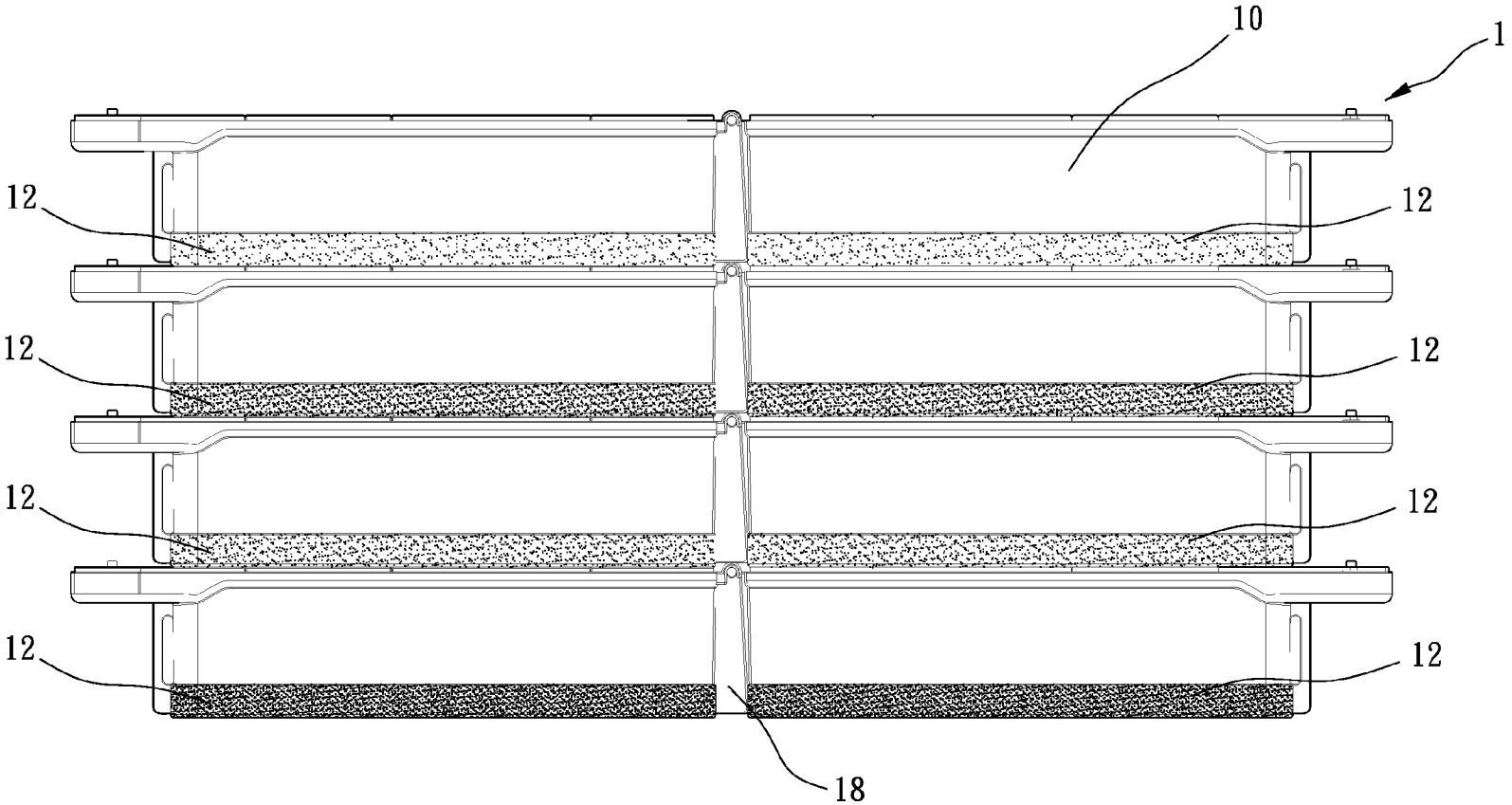
FIG. 4 is a perspective drawing of the preferred embodiment of the present invention unfolded and overlaid on each other.
Figure 5:
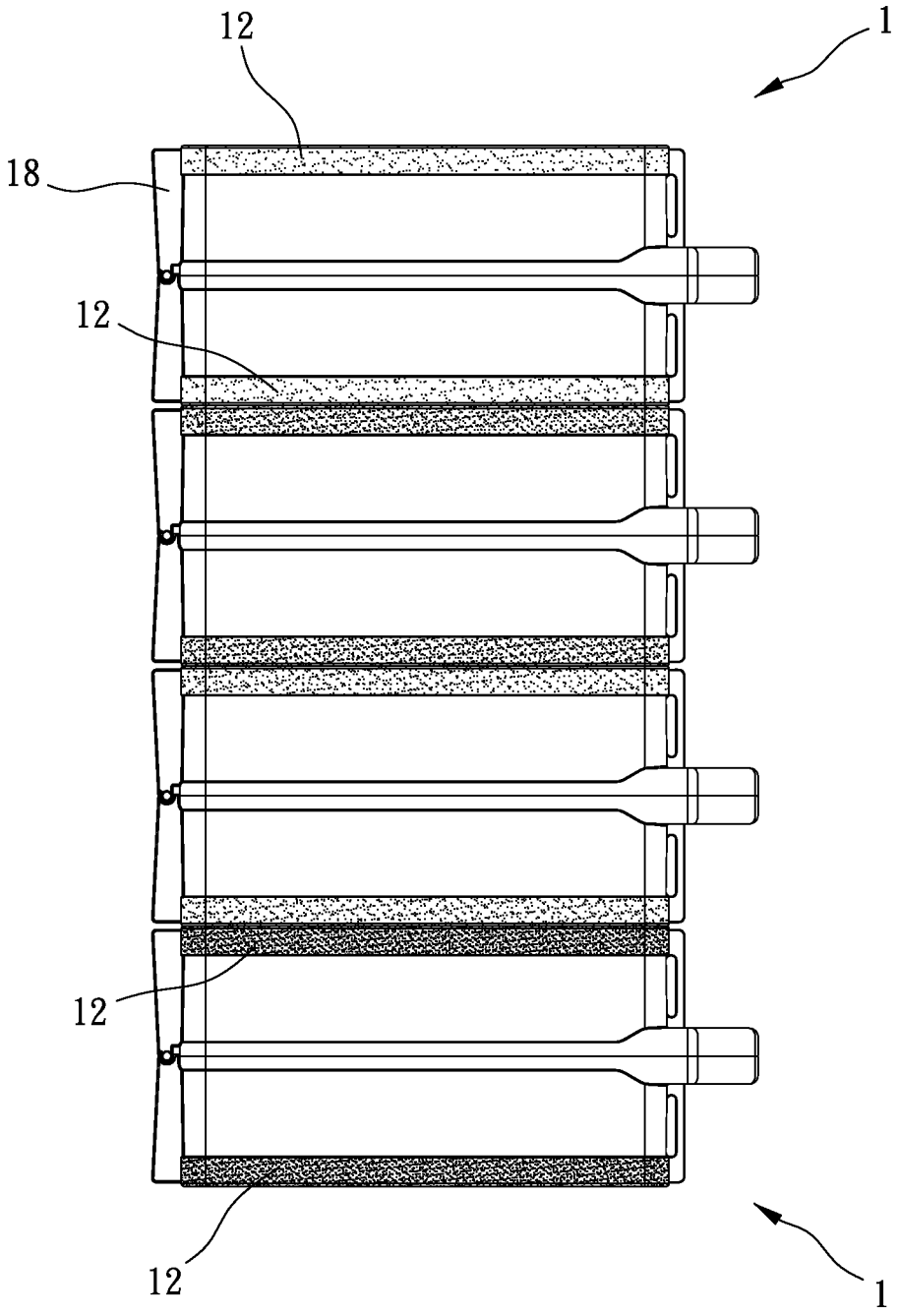
FIG. 5 is a perspective drawing of the preferred embodiment of the present invention folded and overlaid on each other.

By using a structure as described above, the color rings 12 respectively disposed on each said shell body 10 have different colors and are for quickly and clearly identifying the parts received in the storage case 1 (for example, the storage case 1 is provided with the color ring 12 having a corresponding color corresponding to the part). Furthermore, as shown in FIG. 4, when the shell bodies 10 of a plurality of said storage cases 1 are unfolded and overlaid on each other, the two color rings 12 of each said storage case 1 are located neighboring to each other and parallel arranged side by side to form an obvious separating layer. As shown in FIG. 5, when the shell bodies 10 of a plurality of said storage cases 1 are folded and overlaid on each other, the two color rings 12 of each said storage case 1 are arranged in intervals up and down to form an obvious separating interval. Wherein each said color ring 12 is annularly disposed on the circumferential edge (at a distal end) of the shell body 10 and provides a clear side line located between the storage cases 1. It is easy for identifying and unconfused. By using the storage case 1 having the color ring 12 with a color to receive the different parts, it is convenient and rapid for categorizing and storing the parts, and it is also fast and easy to pick up the demanding part from the overlaid storage cases 1.

Furthermore, at least one said shell body 10 is protrudingly formed with at least one said spacer 18 for exactly positioning the two shell bodies 10 which are located neighboring to each other and parallel arranged side by side after the two shell bodies 10 are unfolded, and the two color rings 12 are exactly located at a same level. It is convenient for overlaying, categorizing and separating.

Besides, the color ring 12 can be detachably connected to the circumferential edge of one said main body 11 so that the color ring 12 can be changed to have a different color to meet a requirement, and the color ring 12 which is easily worn and damaged is easy for maintaining and replaced so that the storage case is unnecessary for scrapping.

While we have shown and described various embodiments in accordance with the present invention, it should be clear to those skilled in the art that further embodiments may be made without departing from the scope of the present invention.

What is claimed is:

1. A storage case, comprising:

two shell bodies correspondingly foldably and unfoldably connected to each other, each said shell body including a main body and a color ring arranged around a circumferential edge at an end of the main body, a color of the color ring being different from a color of the main body;

wherein when the two shell bodies are correspondingly folded, the two color rings are disposed substantially parallel to each other in intervals and located at opposite end edges remote from each other of the two shell bodies; when the two shell bodies are unfolded to locate neighboring to each other and parallel arranged side by side, the two color rings are substantially disposed neighboring to each other on a same level.

2. The storage case as claimed in claim 1, wherein at least one said main body of the shell bodies is provided with a handle portion for gripping.

3. The storage case as claimed in claim 1, wherein one of the two main bodies of the two shell bodies is formed with a first pivot portion and a first rib portion which extends from the first pivot portion and is substantially perpendicular to a direction of a pivot axis of the first pivot portion, the other of the two main bodies of the two shell bodies is formed with a second pivot portion and extendingly formed with a second rib portion substantially perpendicular to a direction of a pivot axis of the second pivot portion, and the two shell bodies are pivoted with each other via the first and second pivot portions and correspondingly foldably and unfoldably connected to each other.

4. The storage case as claimed in claim 1, wherein at least one of the two main bodies of the two shell bodies is protrudingly formed with at least one spacer, and after the two shell bodies are unfolded, the spacer abuts against between two opposite sides of the two shell bodies and keeps the two shell bodies being located neighboring to each other and parallel arranged side by side.

5. The storage case as claimed in claim 4, wherein the spacer is substantially a wedge-shaped rib plate transverse to the color ring, and the wedge-shaped rib plate expands towards the color ring.

6. The storage case as claimed in claim 4, wherein each said color ring is formed with at least one engaging slot on an outer circumferential surface thereof and formed with a block slot on a side towards the circumferential edge of the main body, each said block slot and one of the circumferential edges of one said main body are engaged with each other, and each said engaging slot and an end of one said spacer are engaged with each other.

7. The storage case as claimed in claim 6, wherein each said color ring is detachably connected to one of the circumferential edges of one said main body.

8. The storage case as claimed in claim 1, wherein an interior of each said main body defines at least one receiving space, and at least one part receiving box is detachably engagingly disposed and positioned in the receiving space.

9. The storage case as claimed in claim 8, wherein the interior of the main body includes a plurality of engaging ribs, at least two said engaging ribs define one said receiving space, and at least one engaging hook of each said part receiving box is engaged with the engaging rib and positioned in one said receiving space.

10. The storage case as claimed in claim 9, wherein each said engaging rib includes at least one engaging slot, and the engaging slot is for the engaging hook to insert therein and engage therewith.

* * * * *